US010235952B2

(12) United States Patent
Amirkhany

(10) Patent No.: US 10,235,952 B2
(45) Date of Patent: Mar. 19, 2019

(54) DISPLAY PANEL HAVING SELF-REFRESH CAPABILITY

(71) Applicant: SAMSUNG DISPLAY CO., LTD., Yongin, Gyeonggi-Do (KR)

(72) Inventor: Amir Amirkhany, Sunnyvale, CA (US)

(73) Assignee: Samsung Display Co., Ltd. (KR)

( * ) Notice: Subject to any disclaimer, the term of this patent is extended or adjusted under 35 U.S.C. 154(b) by 13 days.

(21) Appl. No.: 15/213,112

(22) Filed: Jul. 18, 2016

(65) Prior Publication Data

US 2018/0018927 A1 Jan. 18, 2018

(51) Int. Cl.
*G09G 3/36* (2006.01)
*G09G 5/00* (2006.01)

(52) U.S. Cl.
CPC ..... *G09G 3/3618* (2013.01); *G09G 3/3677* (2013.01); *G09G 3/3688* (2013.01); *G09G 5/006* (2013.01); *G09G 2300/0842* (2013.01); *G09G 2310/0272* (2013.01); *G09G 2310/0291* (2013.01); *G09G 2310/04* (2013.01); *G09G 2320/029* (2013.01); *G09G 2320/0295* (2013.01); *G09G 2320/103* (2013.01); *G09G 2330/022* (2013.01); *G09G 2340/16* (2013.01); *G09G 2360/18* (2013.01)

(58) Field of Classification Search
None
See application file for complete search history.

(56) References Cited

U.S. PATENT DOCUMENTS 5,764,213 A * 6/1998 Tanaka ..... G09G 3/3625 345/100
6,037,919 A 3/2000 Hanson
6,075,510 A 6/2000 Blouin et al.
6,169,532 B1 1/2001 Sumi et al.
7,006,067 B2 2/2006 Tobita et al.
(Continued)

FOREIGN PATENT DOCUMENTS

CN 103106877 A 5/2013
DE 4409672 A1 9/1995
WO 2014153797 A1 10/2014

OTHER PUBLICATIONS

European Search Report, Application No. 17181937.8, dated Dec. 19, 2017, pp. 1-23.
(Continued)

*Primary Examiner* — Joni Richer
(74) *Attorney, Agent, or Firm* — Innovation Counsel LLP

(57) ABSTRACT

A display device comprises a display panel having a plurality of pixels arranged in pixel rows and pixel columns, and a source circuit. The source circuit includes a plurality of signal lines, each signal line coupled to each pixel of a pixel column; a plurality of column drivers, each column driver connected to one of the signal lines so as to transmit pixel voltages to the pixels of its respective pixel column, the pixel voltages corresponding to image data values for displaying an image upon the display panel; and a plurality of pixel refresh circuits. Each pixel refresh circuit corresponds to one of the signal lines and is coupled to the respective column driver so as to be arranged to determine a voltage stored in the corresponding pixel and to transmit a refresh signal to the respective column driver to refresh the voltage stored in the corresponding pixel.

20 Claims, 5 Drawing Sheets

(56) References Cited

U.S. PATENT DOCUMENTS

| | | | | |
|---|---|---|---|---|
| 8,004,514 | B2 | 8/2011 | Sampsell | |
| 8,587,579 | B2 | 11/2013 | Huangfu | |
| 8,866,710 | B2 | 10/2014 | Teranishi et al. | |
| 2003/0098860 | A1 | 5/2003 | Nakamura | |
| 2004/0233226 | A1 | 11/2004 | Toriumi | |
| 2005/0275446 | A1* | 12/2005 | Hairston | H03F 3/45475 327/336 |
| 2007/0002036 | A1* | 1/2007 | Kardach | G09G 5/006 345/213 |
| 2008/0001934 | A1 | 1/2008 | Wyatt | |
| 2008/0024481 | A1 | 1/2008 | Lee et al. | |
| 2008/0143657 | A1 | 6/2008 | Weiss et al. | |
| 2010/0141636 | A1* | 6/2010 | Marsanne | G09G 3/36 345/213 |
| 2010/0277400 | A1* | 11/2010 | Jeong | G09G 3/3275 345/76 |
| 2011/0216048 | A1 | 9/2011 | Koyama | |
| 2013/0036335 | A1* | 2/2013 | Kim | G09G 3/006 714/704 |
| 2013/0057519 | A1* | 3/2013 | Kerofsky | G09G 5/028 345/204 |
| 2013/0278614 | A1* | 10/2013 | Sultenfuss | G09G 3/3406 345/520 |
| 2014/0043349 | A1* | 2/2014 | Parmar | G09G 3/3473 345/547 |
| 2014/0104472 | A1* | 4/2014 | Kim | H04N 5/335 348/302 |
| 2014/0139505 | A1* | 5/2014 | Han | H04N 13/0438 345/212 |
| 2014/0267336 | A1 | 9/2014 | Jeganathan et al. | |
| 2016/0189689 | A1 | 6/2016 | Cho | |
| 2017/0236473 | A1* | 8/2017 | Huitema | G09G 3/344 345/691 |

OTHER PUBLICATIONS

European Search Report corresponding to EP Application No. 17181937.8, dated Feb. 15, 2018, 35 pages.

Ueda et al., "A Novel Multi-Level Memory in Pixel Technology for Ultra Low Power LTPS TFT-LCD," Display Device Laboratories, Corporate Research and Development Group, Sharp Corporation, Tenri, Nara, Japan. SID 10 Digest; 2010, pp. 615-618. month unknown.

* cited by examiner

DISPLAY PANEL HAVING SELF-REFRESH CAPABILITY

BRIEF DESCRIPTION

Embodiments of the present disclosure relate generally to display devices. More specifically, embodiments of the present disclosure relate to display panels with self-refresh capability.

BACKGROUND

Power consumption is a major concern in the design of modern display devices. In particular, modern displays operate by continuously displaying new images, even when the image is a still image that does not change with time. Thus, one conventional method of reducing display power consumption involves employing a frame buffer memory which stores the successive images that have been displayed. For a still image, succeeding image frames are the same as those previously displayed. Thus, the display fetches and displays the stored image instead of processing and displaying new images from the video signal. This allows components such as the system and panel interfaces to be powered down, thus saving power.

However, this method of conserving display power is not without its drawbacks. As one example, this method is performed on a frame-by-frame basis. Thus, if even one line changes from one frame to the next, no power is saved. Also, this method cannot be implemented with some applications, for example those that do not employ a frame buffer or that do not have system and panel interfaces to be powered down. Finally, the required frame buffers can be quite large and thus occupy an excessive area of the display's chip, or may have to be implemented off-chip.

Continuing efforts thus exist to reduce display power consumption in other ways.

SUMMARY

The invention can be implemented in many different ways. In one exemplary embodiment, a display device comprises a display panel having a plurality of pixels arranged in pixel rows and pixel columns, and a source circuit. The source circuit comprises: a plurality of signal lines, each signal line coupled to each pixel of a pixel column; a plurality of column drivers, each column driver connected to one of the signal lines so as to transmit pixel voltages to the pixels of its respective pixel column, the pixel voltages corresponding to image data values for displaying an image upon the display panel; and a plurality of pixel refresh circuits. Each pixel refresh circuit corresponds to one of the signal lines and is coupled to the respective column driver so as to be arranged to determine a voltage stored in the corresponding pixel and to transmit a refresh signal to the respective column driver to refresh the voltage stored in the corresponding pixel.

Each pixel refresh circuit may further comprise: first and second voltage storage elements arranged to store voltages on the corresponding signal line before and after a voltage sense, respectively; a voltage difference determination element connected to the first and second voltage storage elements and arranged to determine a difference between the voltages stored in the first and second storage elements; and a conversion unit in electronic communication with the voltage difference determination element and arranged to determine the refresh signal from the determined difference between voltages.

The conversion unit may include a look up table (LUT) storing pixel data corresponding to values of the determined difference between voltages, the pixel data further corresponding to voltage values of the refresh signal.

The display panel may further comprise: an application processor arranged to receive a video stream; a timing controller; a system interface connecting the application processor to the timing controller; and a panel interface connecting the timing controller to the source circuit. The application processor may be programmed to compare successive frames of the video stream on a line-by-line basis to determine whether corresponding lines of the successive frames are substantially identical, and to generate a display self-refresh signal for each substantially identical pair of the lines.

The column drivers and the refresh circuits may be further programmed to refresh their respective voltages upon a receiving of the display self-refresh signal.

The display panel may be further programmed to power down the system interface and the panel interface upon detection of the display self-refresh signal.

The display panel may further comprise: an application processor arranged to receive a video stream; a timing controller; a system interface connecting the application processor to the timing controller; and a panel interface connecting the timing controller to the source circuit. The application processor may be programmed to compare less than all lines of successive frames of the video stream to determine whether corresponding line groups of the successive frames are substantially identical, and to generate a display self-refresh signal for each group of the compared less than all lines.

In another exemplary embodiment, a display device comprises: a display panel having a plurality of pixels; an application processor arranged to receive a video stream; and a source circuit connected to the display panel so as to be arranged to drive the pixels according to image data values corresponding to the video stream. The application processor is programmed to compare corresponding portions of successive frames of the video stream to determine whether the corresponding portions are substantially identical, and wherein the source circuit is programmed to refresh voltages of the pixels corresponding to the substantially identical corresponding portions instead of driving the image data values thereto.

The portions may be individual lines of frames of the video stream.

The portions may be groups of lines of frames of the video stream.

The source circuit may further comprise: a plurality of signal lines, each signal line coupled to each pixel of a pixel column; a plurality of column drivers, each column driver connected to one of the signal lines so as to transmit pixel voltages to the pixels of its respective pixel column, the pixel voltages corresponding to the image data values; and a plurality of pixel refresh circuits. Each pixel refresh circuit may correspond to one of the signal lines and may be coupled to the respective column driver so as to be arranged to determine a voltage stored in the corresponding pixel and to transmit a refresh signal to the respective column driver to refresh the voltage stored in the corresponding pixel.

Each pixel refresh circuit may further comprise: first and second voltage storage elements arranged to store voltages on the corresponding signal line before and after a voltage sense, respectively; a voltage difference determination element connected to the first and second voltage storage elements and arranged to determine a difference between the voltages stored in the first and second storage elements; and a conversion unit in electronic communication with the voltage difference determination element and arranged to determine the refresh signal from the determined difference between voltages.

The conversion unit may include a look up table (LUT) storing pixel data corresponding to values of the determined difference between voltages, the pixel data further corresponding to voltage values of the refresh signal.

The display device may further comprise: a timing controller; a system interface connecting the application processor to the timing controller; and a panel interface connecting the timing controller to the source circuit. The display device may be further programmed to power down the system interface and the panel interface upon detection of the display self-refresh signal.

The display device may further comprise a plurality of replica pixels, the source circuit being further arranged to drive the replica pixels according to the image data values. The application processor may be further programmed to sense voltages of the replica pixels so as to determine voltage decays of the replica pixels, and to perform the refresh according to the voltage decays of the replica pixels.

The plurality of replica pixels may be positioned within the timing controller.

A further embodiment may include a method of refreshing an image generated by a display, the method comprising: receiving a video stream corresponding to images to be displayed; comparing corresponding portions of successive frames of the video stream to determine whether the corresponding portions are substantially identical; refreshing voltages of pixels of the display that correspond to the substantially identical corresponding portions of the successive frames; and driving image data values to pixels of the display that do not correspond to the substantially identical corresponding portions of the successive frames.

The method may further comprise: generating a display self-refresh signal for each of the substantially identical corresponding portions; and conditionally performing the refreshing upon the generating.

The method may further comprise, in response to the self-refresh signal, powering down a system interface and a panel interface of the display The corresponding portions may be individual lines of the frames.

The corresponding portions may be groups of lines of the frames.

The refreshing may further comprise: storing, in a first voltage storage element, a driving voltage generated by a column driver and applied to a signal line of the display; storing, in a second voltage storage element, a voltage stored in a pixel; determining a difference between the voltage stored in the first voltage storage element and the voltage stored in the second voltage storage element, so as to determine a difference voltage; determining a pixel refresh voltage from the difference voltage; and refreshing the pixel by driving the pixel refresh voltage to the pixel.

BRIEF DESCRIPTION OF THE FIGURES

For a better understanding of the invention, reference should be made to the following detailed description taken in conjunction with the accompanying drawings, in which.

Like reference numerals refer to corresponding parts throughout the drawings. The various Figures are not necessarily to scale.

DETAILED DESCRIPTION

One embodiment of the invention provides a display that refreshes still images on a line-by-line basis, so that individual lines that do not change from one image frame to the next can be refreshed separately, rather than only refreshing an entire image frame. As a video stream is received, corresponding lines of successive frames are compared to determine whether any lines are unchanging from one frame to the next. A display self-refresh signal is generated for each such unchanging line, so that each line of a frame may have an associated display self-refresh signal (if it represents a still line). In response to this signal, the display turns off the system interface and panel interface, and refreshes the corresponding pixel row instead of driving the pixel data to that row.

Pixel row refresh is carried out by an additional circuit connected to each data line along with its column driver. The refresh circuit is activated on a line-by-line basis in response to the self-refresh signal, and operates by storing the voltage driven to the previous pixel row, and the residual voltage on the pixel of the current row. The difference between these two voltages corresponds to the correct pixel voltage, from which a refresh voltage is determined to refresh the residual voltage back up to the correct pixel voltage.

In this manner, images can be refreshed on a line-by-line basis rather than only on a frame-by-frame basis. This eliminates the need for a dedicated frame buffer for refresh operations, while adding minimal overhead to the driving circuits of the display. Power savings is realized by the ability to turn off the system interface and panel interface for individual lines, thus saving power over the conventional method that is only able to turn off these interfaces when an entire frame is repeated.

Embodiments of the invention also allow for this process to be carried out for groups of lines rather than individual lines.

Figure 1:
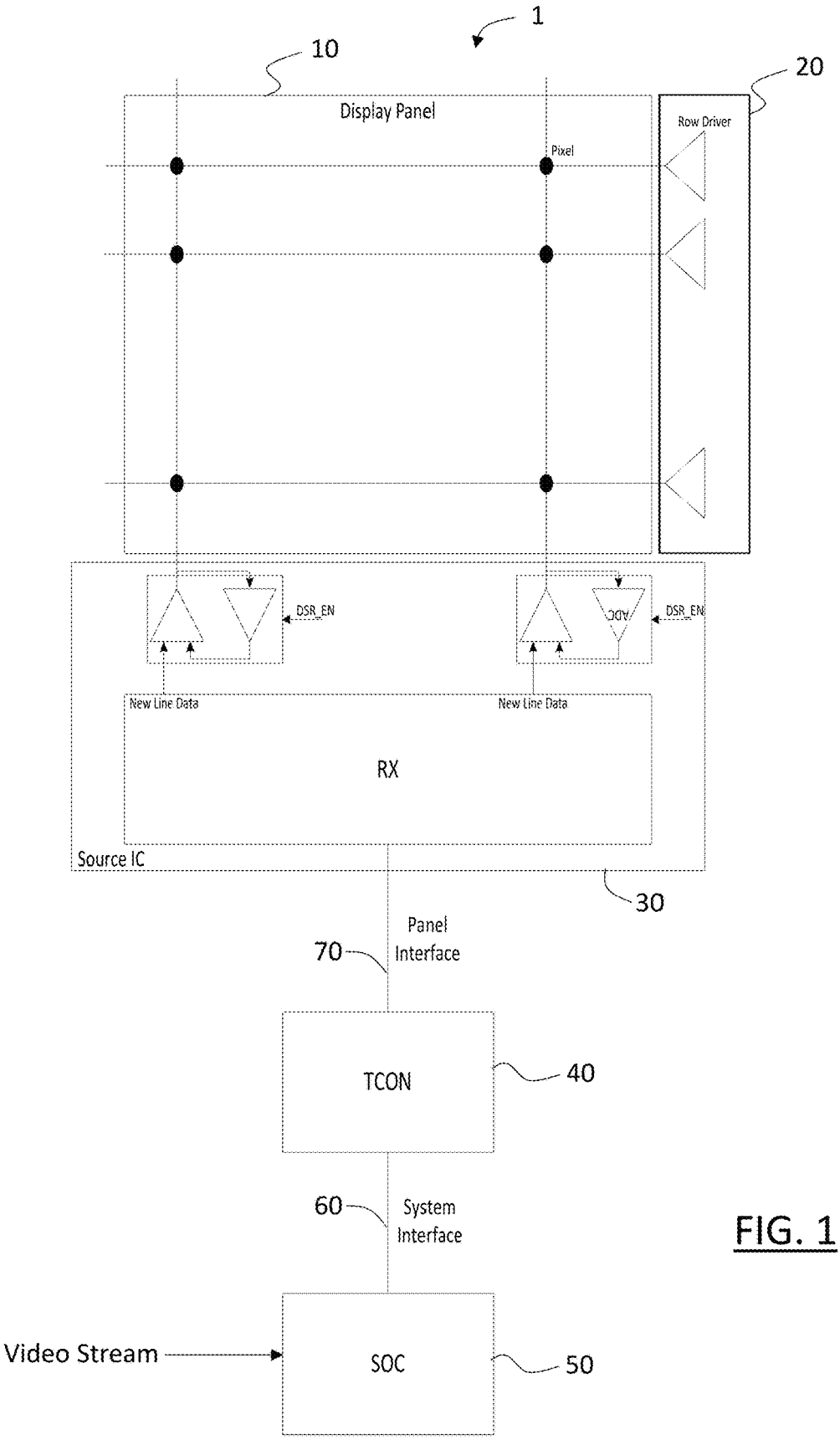
FIG. 1 is a block diagram representation of an exemplary display for implementing embodiments of the present invention.

FIG. 1 is a block diagram representation of an exemplary display for implementing embodiments of the present invention. In FIG. 1, a display system or display device 1 includes a display panel 10, a row driver 20, a source circuit 30, timing controller 40, and an application processor 50. A panel interface 70 connects the timing controller 40 to the source circuit 30, and a system interface 60 connects the application processor 50 to the timing controller 50.

The display panel 10 can be any type of display panel with pixels that can be driven by line, so as to display an image. Examples of such display panels include a liquid crystal display (LCD) panel, an organic light emitting diode (OLED) display panel, electrophoretic and electrowetting display panels, and the like. The display panel 10 contains pixels arranged in a matrix of rows and columns in known manner, to display an image.

The row driver 20 is a driver circuit connected to the pixel rows, for example the gate lines of an LCD or OLED panel, to turn on their switching elements and allow image data to be written or driven to the pixels of a given pixel row. The configuration and operation of row driver 20 is known.

The source circuit 30 is a data driver circuit connected to the pixel columns, for example the data lines of an LCD or OLED panel, to transmit image data to the pixel columns. The source circuit 30 has both column drivers and pixel refresh circuits connected to each data line, as will be described further below. The column drivers drive image data to the pixels of their respective columns when a pixel line or row changes its image data values from one frame to the next, while the pixel refresh circuits refresh the pixel voltages of pixels of their respective columns when the pixel line or row does not change its image data values from one frame to the next.

The timing controller 40 performs conversion operations converting the input video stream to proper format for display upon panel 10. For example, the timing controller 40 performs gamut mapping, gamma conversion, sub-pixel rendering, and the like in known manner.

The application processor 50 receives the input video stream, which contains the images for display upon panel 10 and which may be for example a conventional RGB signal, from an external source. Application processor 50 also compares successive frames of the video stream to determine lines that do not change from frame to frame, and for each such line generates a display self-refresh enable signal DSR_EN. The DSR_EN signal is transmitted along with the video stream through the system interface 60 to the timing controller 40, and then through the panel interface 70 to the source circuit 30.

Figure 2:
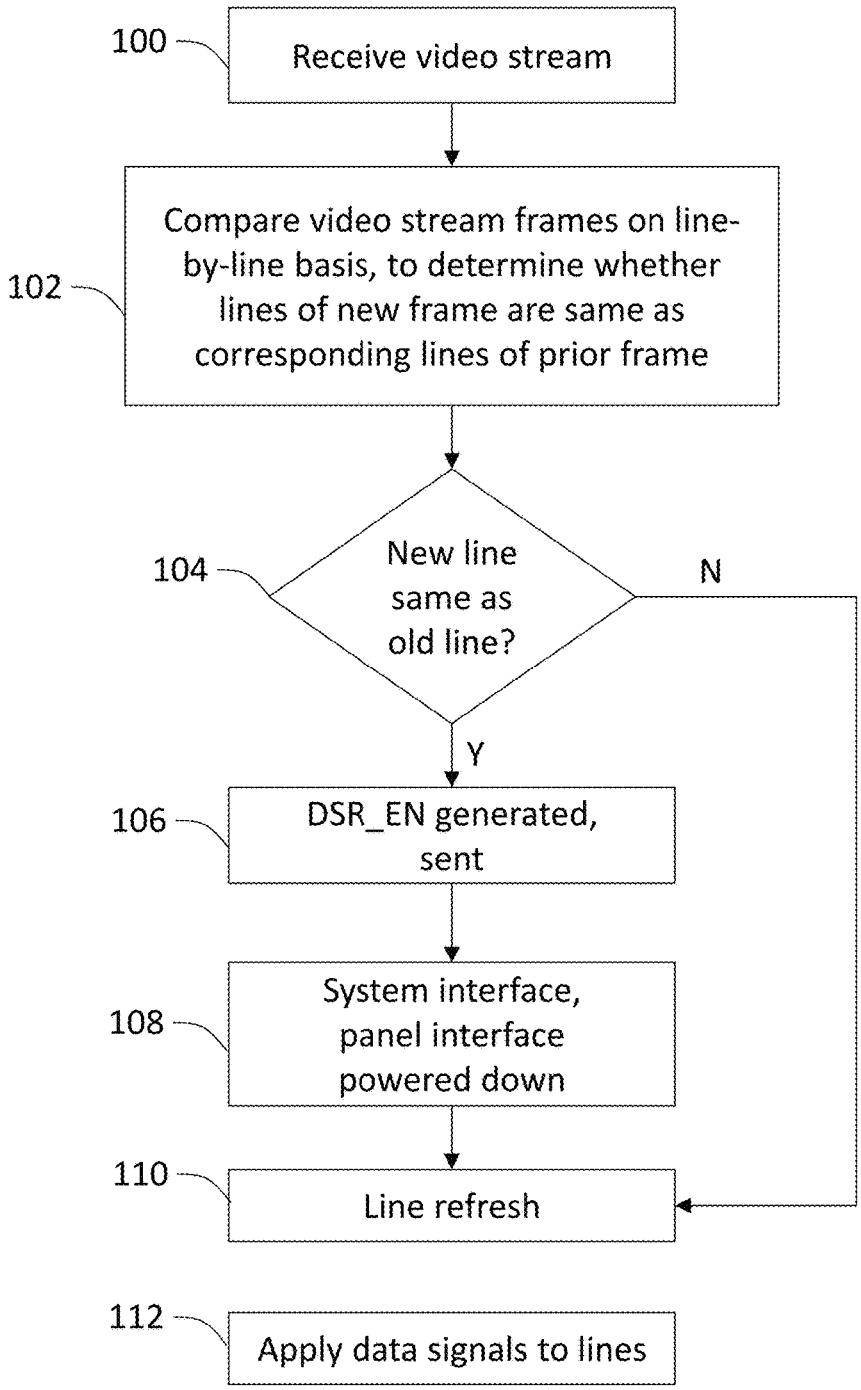
FIG. 2 is a flowchart illustrating a panel self-refresh process according to an embodiment of the present invention.

Operation of the display device 1 according to an embodiment of the invention is illustrated in FIG. 2. FIG. 2 is a flowchart illustrating a panel self-refresh process according to an embodiment of the present invention. The process begins when application processor 50 receives a video stream input from an external source (Step 100). The application processor 50 then compares individual lines of immediately successive frames on a line-by-line basis, to determine whether lines of the successive frame are the same as corresponding lines of the immediate prior frame (Step 102). For each successive line that is identical to the corresponding line of the immediate prior frame (Step 104), the application processor 50 generates a DSR_EN signal and transmits it, instead of the successive line of image data, through the system interface 60 to the timing controller 40 and on through the panel interface 70 to the source circuit 30 (Step 106). In response to receiving the DSR_EN signal, the system interface 60 and panel interface 70 are programmed to power down for the corresponding line of image data (Step 108), as that line of image data need not be sent to the source circuit 30. Upon receiving the DSR_EN signal, the source circuit 30 performs a refresh operation, refreshing the pixel voltage values for each pixel corresponding to the unchanged line of image data (Step 110). Step 110 is described in further detail below.

If the source circuit 30 receives a line of image data without a corresponding DSR_EN signal, then this line of image data is one that is changed from the immediately previous frame. As such, a conventional write operation is performed, with the source circuit 30 writing or driving the image data to the corresponding pixel row (Step 112).

Figure 3:
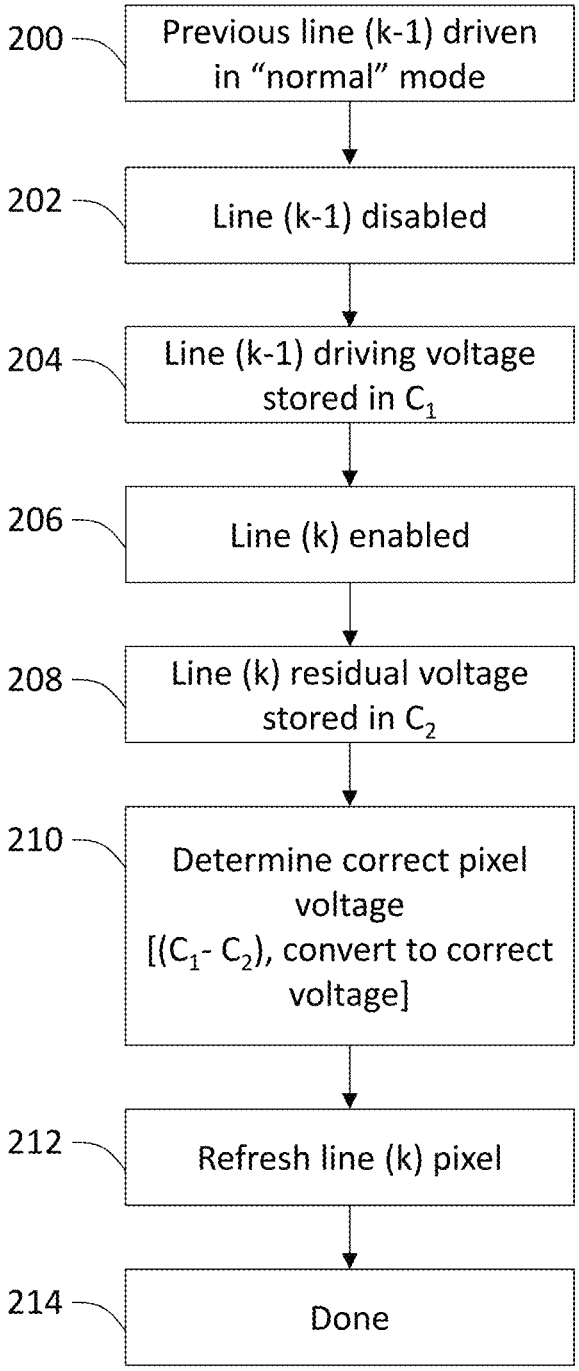
FIG. 3 is a flowchart illustrating further details of a panel self-refresh process according to embodiments of the present invention.

FIG. 3 is a flowchart illustrating Step 110 in further detail. FIGS. 4-7 are circuit diagrams of portions of the source circuit 30 and panel 10, corresponding to Steps of the flowchart of FIG. 3.

As described above, Step 110 entails conditionally performing a refresh operation instead of a conventional image data writing operation. That is, the source circuit 30 may receive either a line of image data or a DSR_ EN signal, depending on whether a particular line of image data is unchanged from the previous frame. When the source circuit 30 receives a line of image data with no associated DSR_EN signal, it performs a conventional write operation, driving the image data values to the appropriate pixel row. When the source circuit 30 instead receives a DSR_EN signal with no image data line, it refreshes the appropriate pixel row instead of driving new image data values to it. FIGS. 3-7 illustrate this latter process in further detail.

Figure 4:
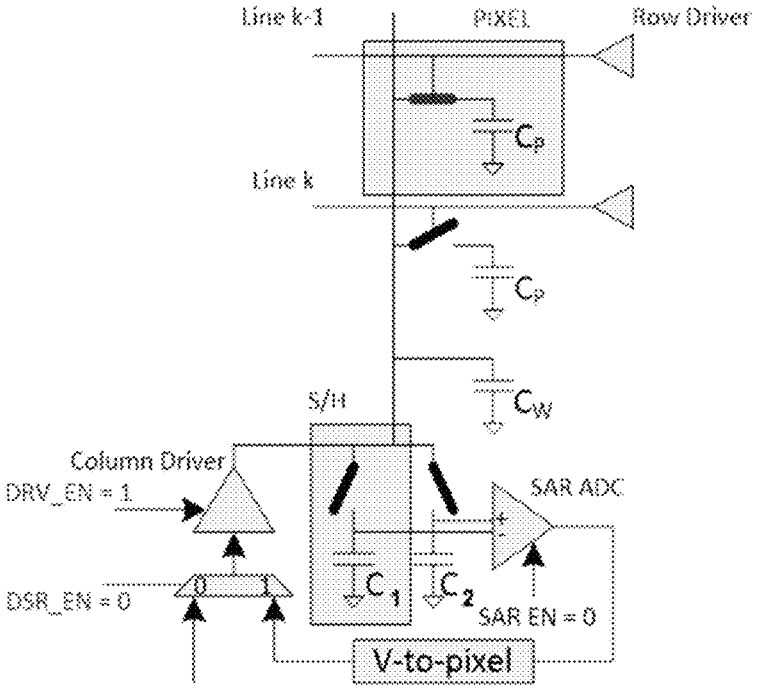
FIG. 4, FIG. 5, FIG. 6, and FIG. 7 are circuit diagrams corresponding to certain steps of the flowchart of FIG. 3.

In FIG. 3, and with reference to FIG. 4, each data line has a conventional column driver and a pixel refresh circuit connected thereto. The pixel refresh circuit has two capacitors or voltage storage elements each switch-connected to the data line, and a voltage difference determination element connected to the two capacitors. The voltage difference determination element outputs its difference signal to a conversion element that converts this voltage difference value to a refresh voltage value, which is sent to the column driver and used to refresh the pixel voltage.

Figure 5:
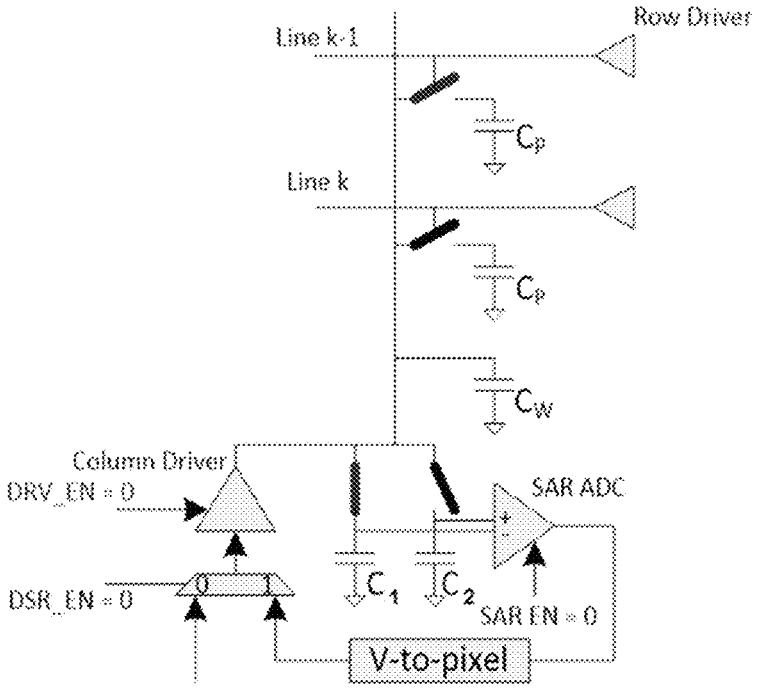
Figure 6:
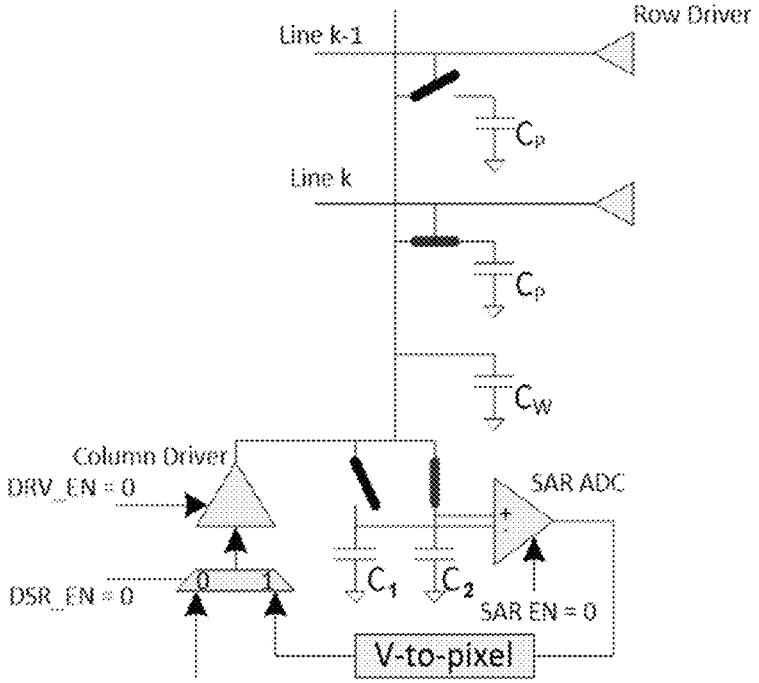
Figure 7:
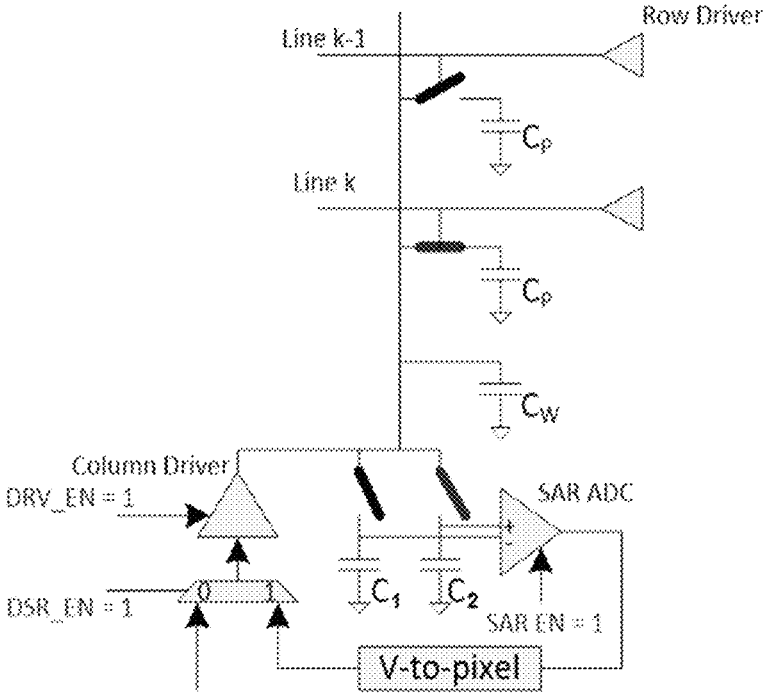

The pixel refresh process begins with a previous gate line (k−1) driven conventionally (Step 200), i.e. with row driver 20 turning on the switching element of the pixel of line (k−1) and the column driver of the data line driving a data signal to the activated pixel to thereby store a pixel voltage in, e.g., LCD capacitor Cp. Line (k−1) may then, but need not necessarily, be disabled (Step 202). With reference to FIG. 5, before line k is enabled and while the driving voltage remains on the data line, a capacitor $C_1$ or other voltage storage element is switch-connected to the data line and the voltage of the column driver/data line is thus stored in capacitor $C_1$ (Step 204). Line k is then enabled (Step 206). With reference to FIG. 6, a capacitor $C_2$ or other voltage storage element is then switch-connected to the data line, so that the residual or present voltage remaining in the pixel of line k is stored in capacitor $C_2$ (Step 208). With reference to FIG. 7, the correct pixel voltage, i.e. the voltage written into the pixel of line k during the previous frame, which is to remain unchanged in the subsequent frame, is then determined from the values stored in capacitors $C_1$ and $C_2$ (Step 210). To accomplish this, it is noted that capacitor $C_1$ stores the known voltage written to the previous line (k−1), while capacitor $C_2$ stores a voltage corresponding to the remaining charge on the data line after it is connected to the pixel of line k, i.e. the difference between the voltage written to line (k−1) and the residual voltage now remaining on the pixel. The difference between these two stored capacitor values is thus the residual voltage remaining on the pixel, and is determined by a known voltage difference determination element such as an analog to digital converter (ADC) shown in FIGS. 4-7.

If the voltage decay as a function of time for the pixels is known, the correct pixel value can then be determined, as the time between frames is also known. Thus, a look up table (LUT) may store voltage decay values corresponding to the determined voltage differences, i.e. the residual pixel voltages, determined by the ADC. Thus, the amount by which the residual pixel voltage has decayed since writing is retrieved from the LUT and sent to the column driver for that pixel, and the column driver drives this voltage to the pixel, restoring its voltage to the value prior to any decay (Step 212). The refresh process for that pixel then ends (Step 214).

One of ordinary skill in the art will realize that other and additional aspects of the invention exist. For example, analog to digital conversion (readout) of the residual pixel voltages and digital to analog conversion (driving) of the corresponding refresh voltages may be performed piecewise as the conversion values are determined. That is, as the most significant bits of the readout are determined, they are converted to analog voltage values and driven into the pixel while the less significant bits of the readout are determined, with this process repeating and successively increasing voltages being applied to the pixel in order, until the pixel voltage is fully refreshed.

As another example, the system 1 need not determine a DSR_EN signal for each individual line, but may instead determine one DSR_EN signal for a group of lines, the group of lines including any desired number of adjacent lines. That is, the system 1 may refresh any arbitrarily-sized portion of a frame, from individual lines to any number of lines at a time.

As a further example, a replica of the display pixel grid can be fabricated on the driver IC chip", and voltage can be sensed on the replica. More specifically, a replica of the display pixel grid is created on the data driver circuit 30. For example, replica pixels may be implemented with TFT transistors and capacitors, like DRAM cells, to simulate the switching and liquid crystal capacitance functions of TFT display pixels. In known manner, similar structures may be implemented on a chip using CMOS transistors. The above-described self-refresh functions are then performed by sensing pixel voltages of the replica, and performing refresh operations based on the sensed replica pixel voltages, i.e. refreshing both the display and replica based on the sensed replica voltages. In this embodiment, the display itself would not have read circuits. Rather, reading of the replica voltages may be performed in known manner, and the data lines of the display may be driven to refresh display pixel values based on the voltage decay sensed in the replica.

In further exemplary embodiments, this replica pixel grid may be placed in the timing controller. In such embodiments, during self-refresh, only the system interface and parts of the timing controller may be turned off, while the panel interface remains on.

Many modifications and variations are possible in view of the above teachings. For example, still images may be determined on a line-by-line basis, a line-group-by-line-group basis, or according to any other image portion as desired. The embodiments were chosen and described in order to best explain the principles of the invention and its practical applications, to thereby enable others skilled in the art to best utilize the invention and various embodiments with various modifications as are suited to the particular use contemplated. Also, individual features of any of the various embodiments or configurations described above can be mixed and matched in any manner, to create further embodiments contemplated by the invention.

What is claimed is:

1. A display device, comprising:

a display panel having a plurality of pixels arranged in pixel rows and pixel columns; and a source circuit, the source circuit comprising:

a plurality of signal lines, each signal line coupled to each pixel of a pixel column;

a plurality of column drivers, each column driver connected to one of the signal lines so as to transmit pixel voltages to the pixels of its respective pixel column, the pixel voltages corresponding to image data values for displaying an image upon the display panel;

a plurality of pixel refresh circuits, each pixel refresh circuit corresponding to one of the signal lines and coupled to the respective column driver so as to be arranged to determine a voltage stored in the corresponding pixel and to transmit a refresh signal to the respective column driver to refresh the voltage stored in the corresponding pixel, and each pixel refresh circuit, when switch-connected to the corresponding one of the signal lines, is directly connected to the corresponding one of the signal lines, and wherein each of the plurality of pixels do not comprise any of the plurality of pixel refresh circuits.

2. The display device of claim 1, wherein each pixel refresh circuit further comprises:

first and second voltage storage elements arranged to store voltages on the corresponding signal line before and after a pixel voltage sense, respectively;

a voltage difference determination element connected to the first and second voltage storage elements and arranged to determine a difference between the voltages stored in the first and second storage elements; and a conversion unit in electronic communication with the voltage difference determination element and arranged to determine the refresh signal from the determined difference between voltages.

3. The display device of claim 2, wherein the conversion unit includes a look up table (LUT) storing pixel data corresponding to values of the determined difference between voltages, the pixel data further corresponding to voltage values of the refresh signal.

4. The display device of claim 1, wherein the display panel further comprises:

an application processor arranged to receive a video stream;

a timing controller;

a system interface connecting the application processor to the timing controller; and a panel interface connecting the timing controller to the source circuit;

wherein the application processor is programmed to compare successive frames of the video stream on a line-by-line basis to determine whether corresponding lines of the successive frames are identical, and to generate a display self-refresh signal for each identical pair of the lines.

5. The display device of claim 4, wherein the column drivers and the refresh circuits are further programmed to refresh their respective voltages upon receiving the display self-refresh signal.

6. The display device of claim 4, wherein the display panel is further programmed to power down the system interface and the panel interface upon detection of the display self-refresh signal.

7. The display device of claim 1, wherein the display panel further comprises:

an application processor arranged to receive a video stream;

a timing controller;

a system interface connecting the application processor to the timing controller; and a panel interface connecting the timing controller to the source circuit;

wherein the application processor is programmed to compare less than all lines of successive frames of the video stream to determine whether corresponding line groups of the successive frames are identical, and to generate a display self-refresh signal for each group of the compared less than all lines.

8. A display device, comprising:

a display panel having a plurality of pixels;

an application processor arranged to receive a video stream;

a source circuit connected to the display panel so as to be arranged to drive the pixels according to image data values corresponding to the video stream;

a timing controller;

a system interface connecting the application processor to the timing controller; and a panel interface connecting the timing controller to the source circuit;

wherein the display device is further programmed to power down the system interface and the panel interface for less than a frame upon detection of a display self-refresh signal;

wherein the application processor is programmed to compare corresponding portions of successive frames of the video stream to determine whether the corresponding portions are identical, and wherein the source circuit is programmed to refresh voltages of the pixels corresponding to the identical corresponding portions instead of driving the image data values thereto; and wherein the source circuit further comprises:

a plurality of signal lines, each signal line coupled to each pixel of a pixel column;

a plurality of column drivers, each column driver connected to one of the signal lines so as to transmit pixel voltages to the pixels of its respective pixel column, the pixel voltages corresponding to the image data values; and a plurality of pixel refresh circuits, each pixel refresh circuit corresponding to one of the signal lines and coupled to the respective column driver so as to be arranged to determine a voltage stored in the corresponding pixel and to transmit a refresh signal to the respective column driver to refresh the voltage stored in the corresponding pixel, and each pixel refresh circuit, when switch-connected to the corresponding one of the signal lines, is directly connected to the corresponding one of the signal lines, and each of the plurality of pixels do not comprise any of the plurality of pixel refresh circuits.

9. The display device of claim 8, wherein the portions are individual lines of frames of the video stream.

10. The display device of claim 8, wherein the portions are groups of lines of frames of the video stream.

11. The display device of claim 8, wherein each pixel refresh circuit further comprises:

first and second voltage storage elements arranged to store voltages on the corresponding signal line before and after a voltage sense, respectively;

a voltage difference determination element connected to the first and second voltage storage elements and arranged to determine a difference between the voltages stored in the first and second storage elements; and a conversion unit in electronic communication with the voltage difference determination element and arranged to determine the refresh signal from the determined difference between voltages.

12. The display device of claim 11, wherein the conversion unit includes a look up table (LUT) storing pixel data corresponding to values of the determined difference between voltages, the pixel data further corresponding to voltage values of the refresh signal.

13. The display device of claim 8 wherein the display device is programmed to power down the system interface and the panel interface for an individual line of a frame upon detection of the display self-refresh signal.

14. The display device of claim 8:

further comprising a plurality of replica pixels, the source circuit being further arranged to drive the replica pixels according to the image data values;

wherein the application processor is further programmed to sense voltages of the replica pixels so as to determine voltage decays of the replica pixels, and to perform the refresh according to the voltage decays of the replica pixels.

15. The display device of claim 14, wherein the plurality of replica pixels is positioned within the timing controller.

16. A method of refreshing an image generated by a display, the method comprising:

receiving a video stream corresponding to images to be displayed;

comparing corresponding portions of successive frames of the video stream to determine whether the corresponding portions are identical;

refreshing voltages of pixels of the display that correspond to the identical corresponding portions of the successive frames; and driving image data values to pixels of the display that do not correspond to the identical corresponding portions of the successive frames, generating a display self-refresh signal for each of the identical corresponding portions;

conditionally performing the refreshing upon the generating; and in response to the display self-refresh signal, powering down a system interface and a panel interface of the display for less than a frame, wherein refreshing voltages of pixels comprises:

providing a plurality of pixel refresh circuits, each pixel refresh circuit corresponding to one of signal lines of the display and coupled to a respective column driver of the display, each pixel refresh circuit, when switch-connected to the corresponding one of the signal lines, is directly connected to the corresponding one of the signal lines, and each of the pixels of the display do not comprise any of the plurality of pixel refresh circuits;

determining a voltage stored in the corresponding pixel; and transmitting a refresh signal to the respective column driver to refresh the voltage stored in the corresponding pixel.

17. The method of claim 16, further comprising, in response to the display self-refresh signal, powering down a system interface and a panel interface of the display for an individual line of a frame.

18. The method of claim 16, wherein the corresponding portions are individual lines of the frames.

19. The method of claim 16, wherein the corresponding portions are groups of lines of the frames.

20. The method of claim 16, wherein the refreshing further comprises:

storing, in a first voltage storage element, a driving voltage generated by a column driver and applied to a signal line of the display;

storing, in a second voltage storage element, a voltage stored in a pixel;

determining a difference between the voltage stored in the first voltage storage element and the voltage stored in the second voltage storage element, so as to determine a difference voltage;

determining a pixel refresh voltage from the difference voltage; and refreshing the pixel by driving the pixel refresh voltage to the pixel.

* * * * *